United States Patent [19]

Guise

[11] 4,121,902

[45] Oct. 24, 1978

[54] STABLE CONCENTRATED POLYMER MIXTURES FOR THE TREATMENT OF TEXTILE MATERIALS

[75] Inventor: Geoffrey Bruce Guise, Highton, Australia

[73] Assignee: Commonwealth Scientific and Industrial Research Organization, Australia

[21] Appl. No.: 636,599

[22] Filed: Dec. 1, 1975

[30] Foreign Application Priority Data

Dec. 4, 1974 [AU] Australia ..... PB9898

[51] Int. Cl.[2] ..... C08F 6/00; C08L 33/08; C08L 33/10; D06M 15/38

[52] U.S. Cl. ..... 8/128 A; 260/29.2 TN; 260/29.6 R; 260/29.6 N; 260/29.6 AQ; 260/29.6 ME; 260/29.6 PM; 260/45.7 R; 260/45.7 S; 528/46; 528/59; 528/71

[58] Field of Search ..... 8/128 A; 260/77.5 TB, 260/77.5 CR, 29.2 TN, 29.6 N, 29.6 R, 29.6 AQ, 29.6 ME, 29.6 PM, 45.7 R, 45.7 S

[56] References Cited

U.S. PATENT DOCUMENTS

| | | | |
|---|---|---|---|
| 3,898,197 | 8/1975 | Guise et al. | 260/77.5 TB |
| 3,984,365 | 10/1976 | Lienert et al. | 260/29.2 TN |

FOREIGN PATENT DOCUMENTS

| | | | |
|---|---|---|---|
| 1,519,859 | 4/1968 | France | 260/77.5 TB |

*Primary Examiner*—John Kight, III
*Attorney, Agent, or Firm*—Dennis P. Clarke

[57] ABSTRACT

Stable concentrated polymer mixtures suitable for the treatment of textile and other materials, are prepared by mixing:

A. An aqueous dispersion, emulsion, or latex containing more than 20% by weight of at least one water-insoluble organic polymer, B. a solution containing at least 10% by weight of at least one polycarbamoyl sulfonate; and C. one or more stabilizers.

14 Claims, No Drawings

STABLE CONCENTRATED POLYMER MIXTURES FOR THE TREATMENT OF TEXTILE MATERIALS

The present invention is concerned with stable concentrated polymer mixtures suitable for the treatment of textile materials, and in particular for the treatment of wool-containing fabrics to render them shrinkresistant. It is to be appreciated that such compositions may also find non-textile uses.

A number of polymeric compositions have been described in the prior art for the treatment of textiles, for example in our copending U.S. application Ser. No. 461,134 fied Apr. 15, 1974 advantageous compositions containing mixtures of polycarbamoyl sulphonates and other polymers were described. The present invention describes further improved compositions of this type, which as well as conferring on textiles the previously discovered improved properties given by the compositions of U.S. application Ser. No. 461,134 have a number of unexpected additional advantages.

The compositions of the present invention are prepared by mixing:

A. an aqueous dispersion, emulsion, or latex of at least one water-insoluble organic polymer which contains more than 20% by weight of said polymer or polymers;

B. a solution in water or in a mixture of water and a water miscible organic solvent of at least one polymer containing on average two or more carbamoyl sulphonate salt groups of the type —NH-$COSO_3^{\ominus}X^+$ (where $X^+$ is a monovalent cation or one equivalent of a polyvalent cation) attached to aliphatic carbon atoms per molecule. Such a polymer will hereafter be referred to as a polycarbamoyl sulphonate using the abbreviation PCS. Said solution must contain at least 10% by weight PCS and such PCS must be freely water soluble; and C. one or more stabilizers and/or stabilizers drawn from either or both of the following classes:
   (a) hindered phenolic antioxidants
   (b) compounds with an average of two or more carbamoyl sulphonate groups, attached to an aromatic ring or rings, per molecule.

In addition the following component may be present:

D. one or more polycationic materials containing an average of two or more amino and/or quaternary ammonium salt groups per molecule. Such amino groups will protonate in acidic solutions to produce cationic species.

The preferred compositions of the invention contain at least 20% non-volatile solids by weight and are prepared by mixing one part by weight of A with from 0.05 to 5 parts B and 0.01 to 1.0 parts C, and optionally from 0.01 to 5 parts D. It is to be further noted that the class C type (b) component may wholly or partially replace the class B component in these mixtures.

Compositions of the present invention have the following advantages over the compositions described in U.S. application Ser. No. 461,134 and used according to the preferred methods described in that specification:

(a) For application to textile materials it is simply a matter of dilution of the composition of the invention with water, whereas in the methods of U.S. application Ser. No. 461,134 it is necessary to mix carefully several components immediately prior to application to textile materials.

(b) The compositions of the invention, being more concentrated than the preferred compositions of U.S. application Ser. No. 461,134, have advantages in storage, handling and transport.

(c) The compositions of the invention have been unexpectedly found to be more stable to prolonged storage at low temperatures than the individual class A components. It is well known that certain polymeric latices of the class A type must be protected from freezing, as freezing or repeated freezing-thawing may coagulate the latex and render it unuseable. It has been unexpectedly found that the compositions of the present invention can be stored without freezing at a temperature which will freeze the class A component or at still lower temperatures where the composition freezes. After such low temperature storage or freezing the compositions of the present invention, when applied to wool and cured imparted a much higher level of shrink resistance than that produced by storing the components A, B and C separately under the same low temperature conditions, and mixing immediately prior to application to wool.

(d) The compositions of the invention have also unexpectedly been found to be more stable to prolonged storage at elevated temperatures or under alkaline conditions than the individual components. In particular PCS of class B or C (b) above, more particularly those of class C (b), have been found to undergo hydrolysis is on storage at elevated temperatures, or at room temperatures under alkaline conditions and this may render them unuseable for the methods of U.S. application Ser. No. 461,134. It has been unexpectedly found that compositions of the present invention may be stored under conditions of elevated temperatures, or in the presence of alkali and when substantially applied to wool impart at high level of shrink resistance, whereas if the PCS component were stored under these conditions it would give very poor shrink resistance if used according to U.S. application Ser. No. 461,134.

(e) In the case when the compositions of the invention contain the optional component D, it has been unexpectedly found that the mixtures of A, B, C and D are stable and do not precipitate whereas mixtures of B and D, being anionic and cationic respectively usually give an immediate precipitate. Also certain products of the class A type are known to precipitate if mixed with those of class D.

It is considered that the previously mentioned advantages of the present invention over the compositions of U.S. application Ser. No. 461,134 reflect differences in chemical composition between these compositions, due to chemical reactions between the components. If it were somehow possible to separate into its component parts, a composition of the present invention, we believe that the components obtained would not be the same, and that a new giant composite polymer to have been formed.

Polymers suited for use as Class A components of the present invention are water insoluble and may have a backbone consisting solely of carbon atoms. Such polymers can be formally considered to be derived from the polymerization of ethylenically unsaturated monomers. Such polymerizations are well known to those skilled in the art of polymer chemistry. Such monomers include the following which may be used alone or in combination; ethylene, propylene, the isometric butylenes, butadiene, isoprene, styrene, the esters and ethers of vinyl alcohol, acrylic and methacrylic acid and their salts, esters, amides, nitriles and acid chlorides, vinyl sulphonic acid, vinyl pyridine, vinyl halides, vinylidene halides, halogenated butadienes, vinyl pyrollidone, maleic acid, allyl alcohol and derived esters and ethers and the like.

Alternatively the backbone of the polymer may contain in addition to carbon atoms one or more of the following types of linkages: ester, amide, ether, urethane, urea, sulphide, disulphide, thioamide, sulphone, carbonate, silicone (i.e.,

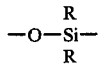

linkages) or the like and thus may be a polyester, polyamide, etc. Such are well known in the prior art and the preparation is well known to those skilled in the art of polymer chemistry.

The polymers may be used singly or in mixtures and must be water insoluble. In the case of water insoluble materials these are most preferably in the form of emulsions, dispersions, latices or dispersions of solutions of such polymers in water immiscible solvents. Such dispersions are hence associated with water in which PCS dissolves.

It is desirable but not essential that polymers A of the present invention contain one or more groups drawn of the following classes:

a. primary amines
b. secondary amines
c. alcohols
d. thiols
e. thiophenols
f. phenols
g. carboxylic acids
h. expoxides
i. episulphides
j. aziridines
k. blocked isocyanates, blocked with the groups such as phenols, thiols, alcohols, amines, amides, $\beta$-diketones, oximes, $\beta$-ketoesters.

Subsequent chemical reaction between these groups and carbamoyl sulphonate or thiocarbamoyl sulphonate groups is conceivable and such reaction is desirable but not essential.

Polymers A may also be of natural origin, for example proteins or polysaccharides including gelatin, collagen, zein, casein, starch alignates and the like. Such natural polymers may be further modified by synthetic chemical reactions, for example, carboxymethylcellulose.

Preferred examples of polymers A may be drawn from one or more of the following classes:

A1. acrylic polymers or copolymers preferably in the form of latices, dispersions or emulsions.
A2. vinyl chloride, chloroprene or vinlidene chloride polymers or copolymers preferably in the form of latices, emulsions or dispersions.
A3. latices of polymers or copolymers of styrene butadiene or acrylonitrile.
A4. latices of polymers or copolymers of vinyl acetate.
A5. polyurethane latices.
A6. blocked isocyanates.
A7. epoxy resins.
A8. silicones.

Classes numbers 1–4, inclusive, constitute polymers whose backbones are essentially carbon atoms alone whereas other linkages are present in the classes 5–7.

Suitable class Al acrylic polymers or copolymers may be prepared by emulsion polymerization methods from a monomer mixture which contains at least 20% of an ester of acrylic or methacrylic acid and a lower aliphatic alcohol. Such acrylic esters include methyl, ethyl, propyl, n-iso and sec butyl, 2-ethylhexyl acrylates and methacrylates. In addition, the following monomers may be present: acrylic or methacrylic acid, acrylamide or methacrylamide (or their N alkyl or N,N dialkyl derivatives), acrylonitrile, methacrylonitrile, the N-methylol or N,N, dimethylol derivatives of acrylamide or methacrylamide or the amides of methacrylic and acrylic acid with primary amines, or the corresponding ethers of the previously-mentioned methylolamides, glycidyl acrylate, glycidyl methacrylate, allyl, glycidyl ether, maleic anhydride, itaconic anhydride, vinylisocyanate, allyl isocyanate, vinyl pyridine, dimethylaminoethylmethacrylate and acrylate, tert-butylaminoethylmethacrylate, vinyl-2-chloroethyl ether.

A number of such products are commercially available and are well known to those skilled in the art of polymer chemistry and these include the following commercial products.

Primals K3, K-14, K87
HA-4, HA-8, HA-12, HA-16
TR-520
B-15
AC-33, AC-61, AC-73
E-358, E-485, E-740, E-751
(Rohm and Haas)

Valbonds 6001, 6004, 6020, 6021, 6022, 6025, 6053, 6063 and 6055. Vlachem Australia Ltd. Polyco 2705, 2719 (Borden Chemical Co.) Texicryl 13-001, 13-002, 13-003, 13-010, 13-100, 13-101, 13-102, 13-104, 13-200, 13-201; 13-202, 13-203, 13-205, 13-430, 13-439 Scott Bader Ltd.

Acramins Lc, 3232, 3187, SLN (Bayer AG)
GEN-Flo 704, (General Mills)
Helazarin Binders FA, UD, TS, NTA (GASF Ltd.)
Vinacryl 63-307 (Vinyl Products Ltd.)
Nacrylic X4280 X-4260 (National Starch and Chem. Corp.)
Stan Chem 6006 6016 6016 6033 (Stanchem Inc.)
Hycar 2600×172 2600×181 (B. F. Goodrich and Co.)

Suitable Class A2 polymers are derived from the polymerization of a mixture containing the weight of at least 20% of one or more of the following monomers, vinyl chloride, vinylidene chloride or neoprene. In addition, monomers listed above for Class A1 may be present. The following additional monomers may also be present - vinyl bromide, vinyl iodide, vinylidene bromide, vinyl iodide, vinylidene bromide, bromobutadiene and halogen substituted styrenes.

A number of such products are commercially available and are well known to those skilled in the art of polymer chemistry and include the following commercial products:

Primal HA-20, E-801N (Rohm Haas)
Monflex 4500, 4514, 4814 (Monsanto)
Polidene 33-004, 33-005, 33-011, 33-012 33-014, 33-050, 33-061, 33-062, (Scott Bader Ltd.)

Neoprene Latex 400, 671 (duPont)
Polyco 2607, 2611, 2612, 2618, 2619, 2622, 2613 (Borden Chemical Inc.)
Lutofan 200D, 300C (BASF)
Kurofan 191D, 231D (BASF)
Dow Latex XD-7577 874
Duran X-805, 220, 225, 211×301, (W. R. Grace & Co.)
Viclan VL412, VL613 (ICI)
Vynachlor 2523, 2542, 2587, 3623, 3647, 78-5159, 78-5337, 7403, 7443 (National Starch and Chemical).
TE-3011 (Quinn and Co.)
Geon 652, 575 × 43, 577, 576, 151, 354, 352, 315, 450 × 167, 450 × 20, 450 × 23, 460 × 1, 552, 660 × 1, 660 × 2, 660 × 4, 590 × 6, 552 (B. F. Goodrich)

The following further examples contain products derived from monomers containing fluorine: Pentel GH-28, F-21, R-24, G-19, D-20, G-26 (Pennwalt Corporation) Zepel B and DR and 2829 (DuPont). Textile Chemical FC 214, 208, 210, 218, 451, 309, 310, (3M Company), Viton Latex 31. (DuPont)

Suitable Class A3 polymers are derived from the polymerization of a mixture containing by weight at least 20% of one or more of the following monomers, acrylonitrile styrene or butadiene. In addition, the monomers listed above for Classes 1 and 2 may be present. A number of such products are commercially available and are well known to those skilled in the art of polymer chemistry and include the following commercial products:

Acralen BN (BASF)
Polyco 220NS, 2410, 2415, 2422, 2426, 2430 (Borden Chemical Co.)
Dow Latex 233, 464, 460 (Dow Chemical)
Hycar 1872 × 6, 1552, 1562, 1571, 2601, 2671, 2600 × 84, 2600 × 106, 2570 × 1, 2570 × 5, 2530 × 2, 1871 × 1, 1877 × 8, 1870 × 3, 1870 × 4 (B.F. Goodrich Chemical Co.)

Suitable Class A4 polymers are derived from the polymerization of a mixture containing at least 20% by weight of vinyl acetate. The following monomers may also be pressure vinyl propionate, and esters of fumaric and maleic acid. In such polymers some of the acelate groups may be subsequently hydrolyzed to form vinyl alcohol residues.

Vinac — AX - 10, AX - 11 (Ariproducts and Chemicals)
Airflex — 120 (Airproducts and Chemicals)
Polyco — 678W, 804, 804PL, 199, 345, 1360 - 15, 529, 577G, 694, 953, 2185, 1361 - 413, 1404 - 30, 11714, 289, 561, 11755, 571, 2166, 505, 522.
(Borden Chemical Inc.)
Resyn — 1025, 78-3500, 78-5301, 78-5344,
(Nahonal Starch and Chemical)
Kemres — 1101/00, 1101/05, 1102/00, 1103/00, 1204, 1205, 1210, 1216, 1230.
(Kemres Chemicals Pty. Ltd.)
Polymer — 5001, 5004, 5011, 5012, 5022, 5024, 5024, 5026
(Stan Chem. Chemicals Inc.)
Texicote — 63-001, 03-004, 03-004 03-006, 03-007, 03-019 03-020, 03-021, 03-030 03-050 (Scott Bader Ltd.)

Polyurethane latices or dispersions suitable for Class A5 of the present invention characteristically contain a plurality of urethane linkages and in addition may contain ester or ether linkages. Such polyurethane latices are produced from the reaction of diisocyanates and polyols, for example, as described in Australian Pat. Nos. 62076/69, 424333, 17876/70.

British Pat. No. 1,078,202, German Pat. Nos. 2,035,729, 2,204,550, 2,035,172, 2,013,160, 2,030,571 and 2,034,479, and are also described by D. Dieterich and H. Reiff Angewandte Makromolekulare Chemie, 26, 85-106, 1972. Examples of commercially available polyurethane latices include Dunlop Resin J67, 664 787, (Dunlop Aust Ltd.)
Desmocoll KA 8066 (Bayer AG Germany)
Impranil BLN and DLH (Bayer AG Germany)
Polyurethane Dispersion B (Bayer AG Germany)

Blocked polyisocyanates suitable for use as Class A6 of the present invention may be formally derived from the reaction of a blocking agent and a polyisocyanate. Such blocked isocyanates on hearing may reform the original isocyanate or by heating with nucleophilic reagents may produce the same products as from the reaction of the same nucleophilic reagent with the parent isocyanates. Examples of blocking groups are above. The polyisocyanates may be any of those discussed previously from which PCS may be derived.

A particular effective example of such polymers containing blocked isocyanates suitable for the purposes of the present invention is the products Adiprene BL16 (DuPont) which has a structure of the following type:

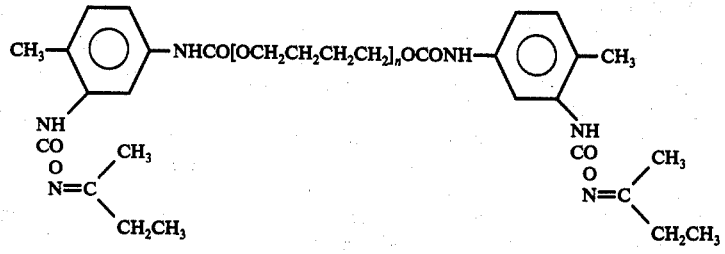

As suitable epoxy resins suitable for Class A7 there may be mentioned glycidyl ethers from bisphenol-A or novolac resins and epichlorhydrin, the glycidyl esters of polycarboxylic acids and the glycidyl ethers of polyethylene or propylene oxide polyols or those derived from the epoxidation of ethylenically unsaturated polymers. As particular examples of such epoxides there may be mentioned the Epikote series of Shell Chemicals, Araldite products of Ciba-Geigy and DER series of Dow Chemical Co.

A further type of epoxy-containing polymer suitable for use in the present invention are those derived from the reaction of isocyanate-containing prepolymers with glycidyl alcohol to give epoxy terminated polyurethanes as described by Sello et al in Textile Research Journal, 1971, page 556. Also there may be used the corresponding aziridine-terminated polyurethanes as described in U.S. Pat. No. 3,542,505 and Australian Patent 63504/69. A further type of aziridineterminated polymer are those described in Textile Research Journal, 33, (1963) 953, which, in addition, contain fluorine atoms.

As examples of silicone polymers suitable for use as Class A8 above are the polysiloxanes which have the repeating unit

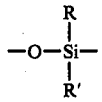

where R and R' are organic radicals such as methyl or ethyl and the like. Such radicals may also contain fluorine atoms. Such polysiloxane chains may be terminated by hydroxyl, halogen, amino or thiol groups, or such chains may be part of block copolymers with blocks of PCS or Class A polymers. Various polymers of this type have been discussed by Kleber, Textil-Praxis International 27 (1972) 449, and in the American Dyestuff Reporter, Oct. 9, 1967, page 23. Examples of such silicones are Dow 551, P-Silicone W5 (Pfersee), Products SM62, 2032, 2033, 2035 and SS4029 (General Electric).

PCS suitable for use as class B components of the present invention have been described in detail in U.S. Pat. No. 3,898,197 and our copending U.S. application Ser. No. 461,134 and preferably have an average from 2 to 4 carbamoyl sulphonate groups per molecule and have an average molecular weight between 500 and 5000. They are preferably prepared from polyisocyanates with an average from 2 to 4 isocyanate groups per molecule and having an average molecular weight between 500 and 5000 by the methods of Australian Pat. No. 460,168. Such polyisocyanates being themselves preferably prepared from aliphatic diisocyanates and compounds containing more than two hydroxyl groups, i.e., polyols. Suitable aliphatic diisocyanates include hexamethylene diisocyanate, bis(4-isocyanatocyclohexyl)-methane and its isomers, (for example the commercial products, Hylene W (du Pont) and Nacconate H-12 (Allied Chemicals), 1-isocyanato-3-isocyanatomethyl-3,5,5-trimethylcyclohexane (known commercially as isophorone diisocyanate), 2-methoxycarbonylpentamethylene diisocyanate (known commercially as lysine diisocyanate), the commercial product DDI (dimer acid diisocyanate, General Mills Inc.), the isomeric bis(isocyanatomethyl)-benzenes and the like. Suitable polyols include those from the polymerisation of cyclic ethers for example ethylene oxide, propylene oxide or tetrahydrofuran alone or in mixtures of in the presence of polyfunctional initiators, for example, glycerol or trimethylolpropane. Particular examples of such polyols include polypropylene oxide diols and triols with average molecular weights from 500 to 5000, and polyoxytetramethylene glycols.

As examples of class C (a) components there may be mentioned the following commercial products: Plastanox 2246 (American Cyanamid), Irganox 415 (Ciba-Geigy), Annullex PBA-15 (William Pearson) and Product 4020 (Bayer). As examples of products suitable as class C (b) components of the present invention there may be mentioned the polycarbamoyl sulphonates derived from compounds containing two or more isocyanate groups attached to an aromatic ring or rings, for example by the methods of U.S. Pat. No. 3,898,197. Suitable aromatic polyisocyanates include the isomeric bisisocyanato derivatives of benzene, toluene, diphenyl, diphenyl methane, chlorobenzene, the xylenes, diphenyl ether, napthalene, the methyl naphthalenes and the like. The preferred examples are 2,4 and 2,6-tolylene diisocyanate. Further examples of aromatic polyisocyanates are the dimers and trimers prepared from the previously mentioned aromatic isocyanates.

Preferred examples of class D components include: (a) Polymers derived from the modification with epichlorohydrin of amino containing polyamides such as those prepared from the condensation adipic acid and dimethylene triamine. Commercial examples of this type are:

Hercosett 57 (Hercules)
Catalyst 3774 (Ciba-Geigy)
Kymene 577 (Hercules)

(b) Cationic starches, for example, from the modification of starch with ethylene imine or by reaction with epichlorhydrin followed by reaction with an amine as described in Encyclopedia of Polymer Science and Technology, Vol. 12, page 843. Commercial examples of this type are Cato 15 (National Starch). (c) Polymers of ethylene imine which may be subsequently wholly or partially quaternized by protonation or by alkylation. Commercial examples of products of this type are Polymer SW and SF (BASF) (Polyethylene imine)
PEI, 6, 16, 18, 600, 1000, 1120 (Dow)
Chemicat series (Chemirad Corporation)
Chemiquat series (Chemirad Corporation)

(d) Quaternized polyvinyl pyrollidone polymers; for example Gafquat 734 and 755 (GAF Corporation).

It will be appreciated that in the preparation of mixtures of components from classes A, B, C and D, for the purposes of the present invention, several different orders of mixing are conceivable and that these may not all be equally effective. For example, if component D is mixed with components B or C (b), a precipitate will most likely form, but if a mixture of A, B, and C is first made, D can then be added to this mixture, precipitation does not occur and a stable concentrated mixture can thus be formed.

Suitable examples of class (D) components are defined as those with a molecular weight in excess of 250 and possessing one or more groups derived from one or more of the following classes.

(a) primary, secondary or tertiary amino groups,
(b) quaternary ammonium, quaternary phosphonium or tertiary sulphonium salt groups,
(c) imonium groups, i.e., $C=\overset{+}{N}-$ The following have been found to be particularly effective cationic agents for class (D) and may be used alone or in admixture A(i) Polyethylene imines such as the commercial products
Polymin SN and SF (BASF)
PEI-16, 18, 600, 1000, 1120 (Dow).

A(ii) Derivatives of polyethylene imines such as N-alkylated derivatives for example
Chemicat Gamma (Chemirad Corp)
or N-Acylated derivatives for example
Chemicats L-10, L-5, S-5, S-10, S-20
WSA-300, EPI-A, C-5, C-10 (Chemirad Corp)

A(iii) Salts of polyamines such as
Reten A-1, 205, 210, 220 (Hercules)
Retaminols A, C and E (Bayer)
Delfloc 50 (Hercules)
Lufax 295 (Rohm and Haas)

Polyteric CA (Glovers Chemicals)
Natron 86 (National Starch)

which are normally used in the paper industry as retention aids and also as flocculants, and are mostly cationic polyacrylamide derivatives.

A(iv) Polyvinylimidazolines such as Primafloc C7(Rohm and Haas)

A(v) Quaternised polyvinyl pyrollidines such as Gafquat 734 and 755 (GAF)

A(vi) Quaternised polyethylene imines such as Chemiquat Alpha, P-145, B5 and P124A (Chemirad Corp)

A(vii) Ionomers such as those formally derived from the reaction of halides of the type $X—(CH_2)_n—X$ and amines of the type

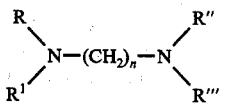

or

Sulphides $R\ S\ (CH_2)_nSR^1$ , or phosphines

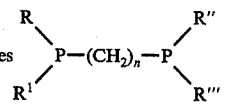

where R, $R^1$, R″ and R‴ are organic radicals.

A(viii) Cationic polymers such as those derived from polyamides containing amino groups in the backbone by reaction with epichlorhydrin such as
Hercosett 57 (Hercules)
Catalyst 3774 (Ciba-Geigy)
Kymene 577 (Hercules)

A(ix) Cationic surfactants of the type $RR_1R_2R_3N^+X^-$ where R, $R_1$, $R_2$ and $R_3$ are organic radicals, one of which is a long aliphatic chain radical.
For example stearylbenzyl dimethylammonium chloride, dodecyltrimethyl ammonium chloride and the like.

A(x) Polysulphonium salts or polyquaternary ammonium salts derived from reaction of polymers containing one or more replaceable halogen atoms with sulphides or tertiary amines, for example the commercial products Synthappret 4387 or SW (Bayer).

A(xi) Cationic starches, for example, from the reaction of starch with ethylene imine, or by reaction with eipchlorhydrin followed by reaction with an amine as described in Encyclopedia of Polymer Science and Technology, Vol. 12, P843.

It is to be appreciated that the class (D) materials may be used singly or a mixture of two or more of the above mentioned compounds may be used.

A mixture of components B and C(b) can be prepared by mixing individual components, or alternatively a mixture of the corresponding polyisocyanates can be prepared and these allowed to react with bisulphite salts for example according to the methods of U.S. Pat. No. 3,898,197. Furthermore it is possible to mix a product of class C (a) with a polyisocyanate and then convert this mixture into a PCS according to the methods of U.S. Pat. No. 3,898,197, during which the component C (a) is unchanged. This thus provides a method to prepare mixture of components B and C.

Further components may be added to the compositions of the present invention and this may also be advantageous. For example when used for the treatment of textile materials, there may be added agents to prevent needle damage during sewing, softening agents, agents which impart resistance to damage by moths, beetles or mildew, enhnace the flame resistance, or the like. A particular advantageous group of compounds which may be added are those with surfactant properties. For example those of the anionic, non-ionic, cationic or amphoteric classes and particularly those prepared from the polymerisation of ethylene oxide.

The preferred application of the compositions of the present invention is for the treatment of textile materials, but they may also be suited for other applications, for example surface coatings, for example on paper or leather, as non-woven binders or as flock binders etc. The present compositions are particularly advantageous for the treatment of textile materials composed wholly or partially from wool in order to render them resistant to shrinkage.

The compositions of the present invention are particularly suited for the treatment of wool or wool blended with other fibres such as polyester. Such fibres may have been subjected to physical or chemical pretreatments. For example, the reaction of wool with halogen, particularly chlorine or compositions which release chlorine (e.g., hypochlorite) oxidizing agents, (e.g., hydrogen peroxide permonosulphuric acid, potassium permanganate) or reducing agents (e.g., bisulphite salts, sodium dithionite or thioglycollic acid).

Impregnation of fibrous materials with the compositions of the present invention may be by padding, dipping, spraying, brushing, knife coating, or the like or by combinations of such methods. Fabrics are most effectively treated by padding. Subsequently to remove water and other volatile substances and also in order to assist in curing of the polymeric mixture, the treated fibrous material may be subjected to a heating treatment. Such heating may be by a direct contact with heated bodies in the form of solid liquids or gases, e.g., hot air or steam or by a radiative means (infrared microwave heating or the like) or by a combination of such methods.

It is to be appreciated that many other modifications can be made to the methods, described above, and that all such modifications are considered to be within the scope of this invention. The following examples are provided to illustrate the present invention but are not to be construed as limiting the invention in any way.

EXAMPLES

PCS were prepared from the corresponding isocyanate terminated prepolymers according to methods of U.S. Pat. No. 3,898,197 by reaction with an aqueous solution containing bisulphite ions in the presence of a water miscible organic solvent preferably ethanol.

Prepolymers containing isocyanate groups were prepared from polyols and a slight excess of diisocyanate according to standard methods. For example the polyol (idealised structure I) a polypropylene oxide triol molecular weight 3000 based on trimethylolpropane (in this case the commercial product Desmophen 3400, Bayer AG, Germany) was converted to prepolymer-A (idealised structure II) by reaction with hexamethylene diisocyanate. The commercial product Synthappret LKF (Bayer AG, Germany) is considered to be an 80% ethyl acetate solution of a prepolymer of similar structure to prepolymer-A.

Prepolymer B- was similarly prepared from Voranol CP3000 (Dow Chemical (a polypropylene oxide triol molecular weight 3000 based on glycerol) and hexamethylene diisocyanate and has the idealised structure (III).

Prepolymer C was prepared from Desmophen 3400 and 1-isocyanato-3-isocyanatomethyl-3,5,5-trimethylcyclohexane (in this case the commercial product isophorone diisocyanate).

Prepolymer D was prepared from Voranol CP3000 and 2,4-tolylene diisocyanate. Helastic LV (Wilmington Chemicals, USA) is a product of this type prepared from commercial tolylene diisocyanate.

I $$CH_3CH_2C\left[CH_2(OCH_2-\overset{CH_3}{\overset{|}{C}}H)_{16}OH\right]_3$$

II $$CH_3CH_2C\left[CH_2(OCH_2-\overset{CH_3}{\overset{|}{C}}H)_{16}OCONH(CH_2)_6NCO\right]_3$$

III $$\begin{array}{l} CH_2-(OCH_2\overset{CH_3}{\overset{|}{C}}H)_6OCONH(CH_2)_6NCO \\ | \\ CH-(OCH_2\overset{CH_3}{\overset{|}{C}}H)_6OCONH(CH_2)_6NCO \\ | \\ CH_2-(OCH_2\overset{CH_3}{\overset{|}{C}}H)_6OCONH(CH_2)_6NCO \end{array}$$

Ethanol. The ethanol referred to in the following examples contained 95% ethanol, 2% methanol and 3% water and was F3 Special Methylated Spirits, C.S.R. Pty. Ltd.

Shrink Resist Effectiveness: To determine the effectiveness is shrink resisting wool fabrics, a sample of the concentrated polymer mixture was diluted with 0.25% sodium bicarbonate solution to give a solution containing 3% polymer. This was then padded at 100% pick-up with a laboratory mangle onto plain weave worsted wool fabric (150 g/m$^2$). Samples were cured in a laboratory Conrad Peter Tenter for 5 minutes at 110° C. The area shrinkage was then measured on relaxed samples after a 3 hour wash in a 50 1 Cubex International Machine with 12.5 1 wash liquor pH 7.5, 40° C. using a load of 1 kg of samples and polyester weighting squares. The untreated fabric after this wash test shrank 70% in area whereas if effective, the treated samples shrank not more than 8% in area under these conditions.

EXAMPLE 1

(a) PCS-Stabilizer Mixture: Synthappret LKF (100 g) was converted to the corresponding PCS by reaction with sodium metabisulphite (8 g) in a mixture of ethanol (160 ml) and water (40 ml). After 15 minutes the hindered phenolic antioxidant Annulex PBA 15 (5 g) (William Pearson) was added, and dissolved by stirring. The mixture was then diluted with water to 30% solids content. Alternatively, the antioxidant could be dissolved in the Synthappret LKF before reaction with the sodium metabisulphite.

(b) Stable Concentrated Mixture: To Primal K3 (100 g) (a polyacrylate ester latex, 46% solids, Rohm and Haas) which was stirred vigorously, the above PCS-stabilizer mixture (50 g) was slowly added. This produced a stable concentrated mixture containing approximately 40% solids, which effectively shrink resisted wool fabric.

If a similar mixture was prepared in which the antioxidant was omitted, this was effective for shrink resisting wool fabric. However, if the wool fabrics treated with this preparation were much more susceptible to loss of the shrink resistance by exposure to heat or sunlight compared with samples treated with the mixture (b) containing antioxidant.

To demonstrate the improved storage properties of this mixture, bottles containing samples of (b) and the parent PCS-stabilizer (a) were placed in a 60° thermostated water bath. After 4 days, the PCS (a) had separated into two viscous layers and on dilution with water gave an extensive precipitate. Attempts to shrink resist wool fabric with this PCS solution used alone or mixed with fresh Primal K3 failed. However, after 4 days the mixture (b) was unchanged and still shrink resisted wool fabric After 8 days at 60° some skin had formed and the shrink resist effectiveness was reduced slightly.

In another experiment samples of the mixture (c) the PCS (a) and Primal K3 were stored in a freezer at −15° C. for a week. Under these conditions Primal K3 and (c) froze. The samples were allowed to thaw, refrozen and this freezing-thawing cycle repeated in all, 4 times. After this sequence the Primal K3 would no longer redisperse completely on thawing and gave poor shrink resistance when mixed with the PCS (a). However, the concentrated mixture (c) redispersed completely after each thawing and gave equivalent shrink resistance to fresh material which had not been frozen.

EXAMPLE II (a) PCS-Stabilizer Mixture: PCS solutions were prepared by the method of Example I using the reactants listed in the following Table. When the PCS formation reaction was complete the antioxidant listed in the Table was dissolved in the PCS solution by stirring.

| No. | Prepolymer | Solvent Mixture | Sodium Metabisulphite | Antioxidant |
|---|---|---|---|---|
| 1 | Synthappret LKF (100g) | Ethanol (200 ml) water (50 ml) | 8 g | Annulex PBA 15 (5 g) |
| 2 | Synthappret LKF (100g) | Ethanol (100 ml) water (25 ml) | 8 g | Annulex PBA 15 (5 g) |
| 3 | Synthappret LKF (100g) | Ethanol (160 ml) water (40 ml) | 8 g | Plastanox 2246 (5 g) (Amer. Cyanamid) |
| 4 | " | " | 8 g | Irganox 415 (5 g) (CIBA-Geigy) |
| 5 | " | " | 8 g | Product 4020 (5 g) (Bayer) |
| 6 | Synthappret LKF (100g) | Isopropanol (200 ml) water (50 ml) | 8 g | Annulex PBA 15 (5 g) |
| 7 | Prepolymer A (80g) | Ethanol (200 ml) water (50 ml) | 8 g | " |

-continued

| No. | Prepolymer | Solvent Mixture | Sodium Metabisulphite | Antioxidant |
|---|---|---|---|---|
| 8 | Prepolymer B (80g) | " | 8 g | " |
| 9 | Prepolymer C (80g) | " | 8 g | " |
| 10 | Prepolymer A (60g) and Prepolymer D (20g) | " | 8 g | " |

(b) Stable concentrated polymer mixtures were prepared by adding the PCS-stabilized mixture from (a) to polymeric latex in the proportions shown in the following table using the method of Example I.

| No. | PCS-Stabilizer Mixture (a) | Polymeric Latex | Final Solids Content (Approx.) |
|---|---|---|---|
| 1 | 1 (26.0g) | Primal K3 (50g) | 40% |
| 2 | 2 (18.3g) | Primal K3 (50g) | 45% |
| 3 | 3 (23.4g) | Primal K3 (50g) | 41% |
| 4 | 4 (23.4g) | Primal K3 (50g) | 41% |
| 5 | 5 (23.4g) | Primal K3 (50g) | 41% |
| 6 | 6 (23.4g) | Primal K3 (50g) | 41% |
| 7 | 7 (24.4g) | Primal K3 (50g) | 41% |
| 8 | 8 (24.4g) | Primal K3 (50g) | 41% |
| 9 | 9 (24.4g) | Primal K3 (50g) | 41% |
| 10 | 10 (24.4g) | Primal K3 (50g) | 41% |

All of the above compositions were found to be effective for shrinkresisting wool fabrics.

EXAMPLE III

Further concentrated compositions were prepared from the PCS-stabilizer mixture prepared in Example I by method of Example I using the proportions in the following table. In some cases the polymer latex was first diluted with water. All compositions were found to be stable to prolonged storage and were effective for shrink resisting wool fabric using the test described above.

| No. | PCS-Stabilizer Mixture (Exple I) | Water | Polymer Latex | Final Solids Content |
|---|---|---|---|---|
| 1 | 40g | — | Primal K3 (100g)(Rohm & Haas) | 41% |
| 2 | 50g | 50 ml | Primal K3 (100g)(Rohm & Haas) | 30% |
| 3 | 80g | — | Primal K3 (100g)(Rohm & Haas) | 38% |
| 4 | 100g | — | Primal K3 (100g)(Rohm & Haas) | 39% |
| 5 | 150g | — | Primal K3 (100g)(Rohm & Haas) | 36% |
| 6 | 50g | — | Primal HA4 (100g)(Rohm & Haas) | 40% |
| 7 | 50g | — | Valbond 6102 (100g)(Valchem Aust.) | 40% |
| 8 | 50g | — | Primal HA-8 (100g)(Rohm & Haas) | 40% |
| 9 | 50g | — | Primal HA-12 (100g)(Rohm & Haas) | 40% |
| 10 | 50g | — | Primal K-14 (100g)(Rohm & Haas) | 40% |
| 11 | 50g | — | Primal K-87 (100g)(Rohm & Haas) | 40% |
| 12 | 54g | — | Primal TR520 (100g)(Rohm & Haas) | 43% |
| 13 | 66g | — | Primal E-358 (100g)(Rohm & Haas) | 48% |
| 14 | 50g | — | Primal E-801N (100g)(Rohm & Haas) | 40% |
| 15 | 50g | — | Primal HA-20 (100g)(Rohm & Haas) | 40% |
| 16 | 50g | — | Texicryl 13-300 (100g (Scott-Bader) | 40% |
| 17 | 50g | — | Acronal 27D (100g) (BASF) | 40% |
| 18 | 50g | — | Helizarin Binder NTA (100g) (Hoechst) | 40% |
| 19 | 50g | 50 ml | Acralen AS (100g) (Bayer) | 30% |
| 20 | 50g | 50 ml | Acronal 30D (100g) (BASF) | 30% |
| 20 | 50g | 50 ml | Primal AC-33 (100g) (Rohm & Haas) | 30% |
| 21 | 50g | 50 ml | Primal AC-34 (100g) (Rohm & Haas) | 30% |
| 22 | 50g | 50 ml | Primal B-15 (100g) (Rohm & Haas) | 30% |
| 22 | 50g | 50 ml | Texicryl B-201 (100g) (Scott-Bader) | 30% |
| 23 | 50g | 50 ml | Texicryl B-301 (100g) (Scott-Bader) | 30% |

EXAMPLE IV

The following example illustrates the use of stabilizers of class (II).

Synthappret LKF (100g) was converted to the corresponding PCS by reaction with sodium metabisulphite (8g) in a mixture of ethanol (160 ml) and water (40 ml). After 20 minutes a solution of IV (10g) in water (50 ml) was added. It may be prepared

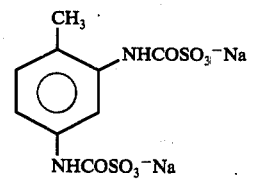

IV from 2,4-tolylene diisocyanate and sodium bisulphite, for example, according to the method of U.S. Pat. No. 2,923,594.

The above PCS solution was then slowly added to Primal K3 (600g) which was being stirred vigorously, and this mixture (40% solids) effectively shrink resists wool fabric.

EXAMPLE V

To illustrate the use of both stabilizers of classes C(a) and C(b). The method of Example IV was amended as follows: After the addition of the solution of IV Annulex PBA-15 (8g) was added and dissolved with stirring.

EXAMPLE VI

Synthappret LKF (100g) and 2,4-tolylene diisocyanate (10g) were mixed and reacted with sodium metabisulphite (12g) in a mixture of ethanol (200 ml) and water (60 ml). After 20 minutes the mixture was diluted with water to 25% solids content. This PCS solution (60g) was then added to Primal K3 (100g) to give a stable concentrated mixture containing about 38% solids, which would effectively shrink resist wool fabric.

EXAMPLE VII

The following example illustrates the use of polycationic component, of class D. To the stable concentrated mixture (b) of Example I (100g) Hercosett 57 (100g) was added with stirring. The resultant mixture was found to be stable, and after prolonged storage at room temperature showed no sign of precipitating. However, if the PCS-stabilizer mixture (a) of Example I was added to Hercosett 57 either in concentrated form or after dilution with water, a precipitate formed. Similarly if Primal K3 and Hercosett 57 were first mixed and then the PCS (a) added to this either before or after dilution with water a precipitate formed.

It was found that this composition would impart a high level of shrink resistance to wool fabric when applied using a long liquor ratio, i.e., it could be applied by exhaustion. This composition also effectively shrink resisted wool fabric if applied by padding.

EXAMPLE VIII

It was found that certain polymer latices, when converted into a stable concentrated mixture according to the method of Example III, the resultant mixture thickened on storage. However, this can be overcome by first adjusting the pH of the polymer later to pH3 by the addition of a few ml of 5% hydrochloric acid, and in some cases by also diluting the polymer latex with water. The following table lists some compositions of this type, all of which were found to be stable to prolonged storage and effective for shrink-resisting wool fabric.

| No. | PCS Stabilizer Mixture (Exam. 1) | Water | Polymer Latex (Acidified to pH3) | Final Solids, % |
|---|---|---|---|---|
| 1 | 50g | — | Primal E485 (100g) (Rohm & Haas) | 40 |
| 2 | 50g | — | Acralen KA8112 (Bayer) | 40 |
| 3 | 50g | 50 ml | Acralen ATN (Bayer) | 30 |

EXAMPLE IX

The following example demonstrates the use of a PCS derived from a polyisocyanate in which all the isocyanate groups are attached to aromatic classes, i.e., the class B component is wholly replaced by a PCS of class C type (b).

Prepolymer E: A polyisocyanate of 4.0% isocyanate content was prepared by heating at 60° for 4 hours, dried Desmophen 3400 and one equivalent of 2,4-tolylene diisocyanate.

Conversion to PCS: The conditions required for conversion of prepolymer E into a PCS were found to be more critical than required for prepolymers A, B and C and this is demonstrated in the following examples.

Prepolymer E (10g) was dissolved in dry dioxan (3g) and stirred rapidly. The alcohol was added immediately, followed by an aqueous solution containing bisulphite and other salts. The total weight of alcohol and water used was 35g and the proportions used are listed in column 3 of the Table. The extent of conversion of isocyanate groups into carbamoyl sulphonates was determined by the following method and is listed in column 4 of the Table. A solution of the PCS (5g) in a mixture of water (75 ml) and isopropanol (100 ml) was titrated against 0.05M iodine solution containing potassium iodide to the iodine colour end-point. This titre gave the content of free bisulphite. Sodium hydroxide solution (10 ml of 30% w/v) was added to the solution, and after 2 minutes this was acidified with sulphuric acid solution (25 ml of 20% w/v). This results in quantitative decomposition of the carbamoyl sulphonates releasing bisulphite which was estimated by a second titration with 0.05M iodine.

| Experiment | No. of Equivalents per Equivalent of Isocyanate Groups | | Solvent (w/w) | % Conversion of Isocyanates to Carbamoyl Sulphonates |
|---|---|---|---|---|
| 1 | 1.2 $NaHSO_3$ | 60% | isopropanol | 19 |
| 2 | 1.5 $NaHSO_3$ | " | " | 21 |
| 3 | 1.0 $NaHSO_3$ + 0.2 $Na_2SO_3$ | 50% | " | 59 |
| 4 | " | 60% | " | 69 |
| 5 | " | 70% | " | 45 |
| 6 | " | 80% | " | 11 |
| 7 | " | 50% | ethanol | 54 |
| 8 | " | 60% | " | 64 |
| 9 | " | 70% | " | 51 |
| 10 | 1.0 $NaHSO_3$ + 0.4 $Na_2SO_3$ | 60% | isopropanol | 71 |
| 11 | 1.2 $NaHSO_3$ + 0.2 $Na_2SO_3$ | " | " | 70 |
| 12 | 1.0 $NaHSO_3$ + 0.1 $Na_2SO_3$ | " | " | 69 |
| 13 | 0.6 $NaHSO_3$ + 0.6 $Na_2SO_3$ | " | " | 68 |
| 14 | 1.2 $KHSO_3$ | " | " | 10 |
| 15 | 1.2 $KHSO_3$ + 0.2 $NA_2SO_3$ | " | " | 61 |

These experiments demonstrate that the use of bisulphite salts alone gave poor yields, however, the addition of a small amount of a sulphite salt resulted in good yields. Solutions containing sulphite and bisulphite salts could be prepared either by mixing the appropriate salts or their solutions, or alternatively by the addition of an alkali metal hydroxide to a bisulphite solution. The solvent composition also influenced the extent of PCS formation and 60% isopropanol was preferable.

Stable Concentrated Mixtures: These were prepared as above from samples of the PCS prepared in experiment 10 which contained approximately 24% solids.

| PCS No. | 10 | Water | Other Additives | Polymer | Latex | Final Solids |
|---|---|---|---|---|---|---|
| 1 | 30g | — | | Primal K3 | (50g) | 38% |
| 2 | 30g | 30 ml | | " | (50g) | 28% |
| 3 | 30g | — | | " | (70g) | 40% |
| 4 | 30g | 30 ml | 0.6g Annulex PBA15 | Primal K3 | (50g) | 28% |
| 5 | 15g | | 15g PCS from Example 1 | " | (50g) | 39% |
| 6 | 15g | | 15g PCS from Example 1 0.65g Annulex PBA15 | " | (50g) | 39% |

Samples of the PCS from experiment No. 10 after 1 week at room temperature had separated into two layers and dilution with water gave a precipitate. In contrast the concentrated mixtures were stable for at least 3 months and after such storage were still capable of effectively shrink-resisting wool fabric.

The concentrated mixtures could be stabilized further by addition of 5% hydrochloric acid (1 ml for 50g of concentrate).

Stable concentrated mixtures could also be prepared using the PCS prepared in experiments 4, 8, 11, 12 and 13 and showed identical behaviour to those prepared from experiment 10.

EXAMPLE X

In the following example some commercial polyisocyanates based on aromatic diisocyanates were converted into PCS. The polyisocyanate (10 g) was dissolved in dioxan (3g) and stirred vigorously. Isopropanol was added immediately followed by an aqueous solution containing sodium metabisulphite and sodium sulphite. The quantities of reactants used are given in the following Table.

| | Polyisocyanate | Sodium Metabisulphite (g) | Sodium sulphite (anhydrous) (g) | Water (ml) | Isopropanol (ml) |
|---|---|---|---|---|---|
| 1. | Desmodur E14 (Bayer) | 0.83 | 0.21 | 14 | 25 |
| 2. | Helastic LU (Wilmington) | 0.93 | 0.24 | 14 | 25 |
| 3. | Castomer E002 (Witco) | 0.76 | 0.19 | 14 | 25 |
| 4. | Castomer E0027 (Witco) | 1.02 | 0.26 | 14 | 25 |
| 5. | Adiprene L100 (du Pont) | 1.2 | 0.27 | 20 | 35 |

In all cases, analysis using the method in example showed that 65% or more of the isocyanate groups had been converted into carbamoyl sulphonates.

20 minutes after the preparation was started, the reaction mixtures were diluted with water to 15% solids content and 30g of the 15% material was added to Primal K3 (30g) to give a stable concentrated mixture (30% solids content). Further stabilization could be effected by the addition of 5% hydrochloric acid (1 ml per 50g of concentrate).

In all cases the PCS, as prepared above, on storage at 20°, decomposed into water insoluble material after several weeks. However, the corresponding concentrated mixtures were stable for at least 3 months storage, and after such storage still were effective for shrink-resisting wool.

EXAMPLE XI

In the following, polyisocyanates were prepared by heating at 60°, polyols with a one mole of diisocyanate per hydroxyl group. The polyols were first dried by azeotropic distillation with benzene followed by removal of the solvent. Heating was continued until the isocyanate content became constant which usually occurred after about 4 hours.

| No. | Polyol | Diisocyanate | Isocyanate Content, % |
|---|---|---|---|
| 1 | Desmophen 3400 | Desmodur T-80 (Bayer)[a] | 3.9 |
| 2 | Desmophen 3400 | Desmodur T-65[b] | 4.2 |
| 3 | Desmophen 3900[c] | 2,4-tolylene Diisocyanate | 2.8 |
| 4 | Desmophen 3300[d] | " | 3.5 |
| 5 | Polypropylene oxide glycol (MW = 2000) | " | 4.0 |
| 6 | " | Desmodur T-80 | 3.9 |
| 7 | " | Desmodur T-65 | 4.0 |
| 8 | Polypropylene oxide glycol (MW = 900) | 2,4-tolylene Diisocyanate | 6.2 |
| 9 | Polyoxytetramethylene glycol (MW = 2000) | " | 4.1 |
| 10 | Polyoxytetramethylene glycol (MW = 1000) | " | 6.4 |

[a]80% 2,4- and 20% 2,6-tolylene diisocyanates.
[b]65% 2,4- and 35% 2,6-tolylene diisocyanate.
[c]Polypropylene oxide triol, tipped with ethylene oxide, hydroxyl number = 35.
[d]Polypropylene oxide triol, molecular weight = 4000.

These polyisocyanates were converted to PCS by reaction with 1.0 equivalents of sodium bisulphite and 0.2 equivalents of sodium sulphite in 60% isopropanol-water at 25% solids for polyisocyanates 1–7 and 15% solids for 8–10.

In all cases the PCS, as prepared, after 1–2 weeks storage, decomposed into water insoluble material, however, if added to Primal K3 as in the previous example, stable concentrated mixtures were obtained which were effective for shrink-resisting wool fabrics.

I claim:

1. A composition which is prepared by mixing together:
   A. an aqueous dispersion, emulsion, or latex of at least one water-insoluble polymer obtained by the polymerization of a mixture of ethylenically unsaturated monomers containing at least 20% by weight of esters of acrylic or methacrylic acid with lower alphatic alcohols which contains more than 20% by weight of said polymer or polymers;
   B. a solution in water or in a mixture of water and a water miscible organic solvent of at least one polymer containing on average per molecule two or more carbamoyl sulphonate salt groups of the type $-NHCOSO_3\ ^{\ominus}X^{\oplus}$ (where $X^{\oplus}$ is a monovalent cation or one equivalent of a polyvalent cation) attached to aliphatic carbon atoms; said polymer being freely water-soluble and being present in said solution in an amount of at least 10% by weight; and
   C. one or more stabilizers drawn from either or both of the following classes:
      (a) hindered phenolic antioxidants
      (b) compounds with an average of two or more carbamoyl sulphonate groups, attached to an atomatic ring or rings, per molecule.

2. A composition as claimed in claim 1, and further comprising:
   D. one or more polycationic materials containing an average of two or more amino and/or quanternary ammonium salt groups per molecule.

3. A composition as claimed in claim 1, which contains at least 20% non-volatile solids by weight and is prepared by mixing one part by weight of component A with from 0.05 to 5 parts by weight of compound B and 0.01 to 1.0 parts by weight of component C.

4. A composition as claimed in claim 2, which contains at least 20% non-volatile solids by weight and is prepared by mixing one part by weight of component A with from 0.05 to 5 parts by weight of component B, 0.01 to 1.0 parts by weight of component C and 0.01 to 5 parts by weight of component D.

5. A composition as claimed in claim 1, wherein the component B is wholly or partly replaced by a component of class C type (b).

6. A composition as claimed in claim 1, wherein component A is a latex obtained by the polymerisation of a mixture of ethylenically unsaturated monomers containing at least 50% by weight of esters of acrylic or methacrylic acid with lower aliphatic alcohols.

7. A composition as claimed in claim 1, wherein component B contains an average of from 2 to 4 carbamoyl sulphonate groups per molecule and has an average molecular weight of from 500 to 5000.

8. A composition as claimed in claim 7, wherein said component B is prepared from a polyisocyanate with an average from 2 to 4 isocyanate groups per molecule and having an average molecular weight between 500 and 5000, said polyisocyanate being prepared from aliphatic diisocyanate and a polyol containing more than two hydroxyl groups.

9. A composition as claimed in claim 1,
wherein the component C(b) is a polycarbamoyl sulphonate derived from a compound containing two or more isocyanate groups attached to an aromatic ring or rings.

10. A composition as claimed in claim 2,
wherein the component D is selected from the following classes:

(a) Polymers derived from the modification with epichlorohydrin of amino containing polyamides,
(b) Cationic starches;
(c) Polymers of ethylene imine, including such polymers which have been wholly or partially quaternized by protonation or by alkylation; and
(d) Quaternized polyvinyl pyrrollidone polymers.

11. A composition as claimed in claim 1,
for use in textile treatment and further including one or more substances which act as agents to prevent needle damage during sewing, softening agents, or agents which impart resistance to damage by moths, beetles or mildew, or enhance the flame resistance of the treated material.

12. A composition as claimed in claim 11, wherein one of said substances is a surfactant.

13. A method for preparation of a composition according to claim 1, wherein components A, B and C are mixed together and component D, when used, is added to the mixture.

14. A method as claimed in claim 13, wherein a mixture of components B and C(b) is first prepared by forming a mixture of the corresponding polyisocyanates and reacting the mixed polyisocyanates with a bisulphite salt.

* * * * *